US009514757B2

(12) United States Patent
Oshikiri et al.

(10) Patent No.: US 9,514,757 B2
(45) Date of Patent: Dec. 6, 2016

(54) STEREO SIGNAL ENCODING DEVICE, STEREO SIGNAL DECODING DEVICE, STEREO SIGNAL ENCODING METHOD, AND STEREO SIGNAL DECODING METHOD

(75) Inventors: Masahiro Oshikiri, Kanagawa (JP); Hiroyuki Ehara, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 738 days.

(21) Appl. No.: 13/882,750

(22) PCT Filed: Oct. 17, 2011

(86) PCT No.: PCT/JP2011/005791

§ 371 (c)(1),
(2), (4) Date: May 1, 2013

(87) PCT Pub. No.: WO2012/066727

PCT Pub. Date: May 24, 2012

(65) Prior Publication Data

US 2013/0223633 A1 Aug. 29, 2013

(30) Foreign Application Priority Data

Nov. 17, 2010 (JP) ..... 2010-256915

(51) Int. Cl.
*H04R 5/00* (2006.01)
*G10L 19/008* (2013.01)
*G10L 19/22* (2013.01)

(52) U.S. Cl.
CPC ..... *G10L 19/008* (2013.01); *G10L 19/22* (2013.01)

(58) Field of Classification Search
CPC .... G10L 19/008; G10L 19/22; G10L 19/167
USPC ..... 700/94; 381/21, 22, 56
See application file for complete search history.

(56) References Cited

U.S. PATENT DOCUMENTS 7,945,447 B2 5/2011 Yoshida et al.
2005/0053242 A1 3/2005 Henn et al.

(Continued)

FOREIGN PATENT DOCUMENTS

CN 101027718 8/2007
CN 101091208 12/2007

(Continued)

OTHER PUBLICATIONS

Ville Pulkki et al., "Localization of Amplitude-Panned Virtual Sources, I: Sterophonic Panning", J. Audo Eng. Soc. vol. 49, No. 9, pp. 739-752, Sep. 2001.

(Continued)

*Primary Examiner* — Vivian Chin
*Assistant Examiner* — Douglas Suthers
(74) *Attorney, Agent, or Firm* — Greenblum & Bernstein, P.L.C.

(57) ABSTRACT

A stereo signal encoding device is provided that enables a lower bitrate without decreasing quality when applying an intermittent transmission technique to a stereo signal. A stereo encoding unit generates first stereo encoded data by encoding the stereo signal when the stereo signal of the current frame is an audio section. A stereo DTX encoding unit is a means for encoding the stereo signal when the stereo signal of the current frame is a non-audio section. The stereo DTX encoding unit generates second stereo encoded data by encoding each of a monaural signal spectral parameter that is a spectral parameter of a monaural signal generated using the first channel signal and the second channel signal, first channel signal information relating to the first channel signal, and second channel signal information relating to the second channel signal.

4 Claims, 9 Drawing Sheets

(56) References Cited

U.S. PATENT DOCUMENTS

| | | | | |
|---|---|---|---|---|
| 2005/0177360 | A1 | 8/2005 | Schuijers et al. | |
| 2005/0256701 | A1* | 11/2005 | Makinen | G10L 19/22 704/223 |
| 2005/0261892 | A1 | 11/2005 | Makinen et al. | |
| 2008/0010072 | A1 | 1/2008 | Yoshida et al. | |
| 2008/0255832 | A1* | 10/2008 | Goto | G10L 19/008 704/219 |

FOREIGN PATENT DOCUMENTS

| | | |
|---|---|---|
| JP | 2004-535145 | 11/2004 |
| JP | 2005-533271 | 11/2005 |
| JP | 2007-079483 | 3/2007 |
| JP | 2007-538281 | 12/2007 |
| JP | 2008-503783 | 2/2008 |
| WO | 03/007656 | 1/2003 |

OTHER PUBLICATIONS

B. Cheng et al., "Principles and Analysis of the Squeezing Approach to Low Bit Rate Spatial Audio Coding", ICASSP, pp. I-13-I-16, 2007.

"3rd Generation Partnership Project; Technical Specification Group Services and System Aspects; Manaday Speech Codec speech processing functions; AMR Speech Codec; Comfort noise aspects (Release 4)", 3GPP TS 26.092 V4.0.0, Mar. 2001.

B. Bessette et al., "A Wideband Speech and Audio Codec at 16/24/32 KBit/s Using Hybrid ACELP/TCX Techniques", IEEE, pp. 7-9, 1999.

J. Makinen et al., "Source signal based rate adaptation for GSM AMR speech codec", IEEE, pp. 308-313, 2004.

International Search Report, mailed Nov. 8, 2011, for International Application No. PCT/JP2011/005791.

Search Report (English language translation) annexed to China Office Action, dated Apr. 1, 2014, for corresponding Chinese Patent Application.

* cited by examiner

STEREO SIGNAL ENCODING DEVICE, STEREO SIGNAL DECODING DEVICE, STEREO SIGNAL ENCODING METHOD, AND STEREO SIGNAL DECODING METHOD

TECHNICAL FIELD

The present invention relates to a stereo signal encoding apparatus, a stereo signal decoding apparatus, a stereo signal encoding method, and a stereo signal decoding method.

BACKGROUND ART

In mobile communication systems, in order to make effective use of radio spectrum resources and the like, there is a need to compress a speech signal to a low bit rate for transmission thereof. There is also a desire for a telephone service with improved speech quality and a good feeling of naturalness, and the achievement thereof makes desirable the high-quality encoding of not only monaural signals, but also multichannel audio signals, and in particular stereo audio signals.

A known method for encoding a stereo audio signal at low bit rate is the intensity stereo method. In the intensity stereo method, a monaural signal is multiplied by scaling coefficients to generate an L-channel signal (left-channel signal) and an R-channel signal (right-channel signal). A method such as this is called amplitude panning.

The most basic method of amplitude panning is that of multiplying a monaural signal in the time domain by gain coefficients for amplitude panning (panning gain coefficient) to determine the L-channel signal and the R-channel signal (refer, for example, to the Non-Patent Literature 1). Another method is that of multiplying a monaural signal by panning gain coefficients for each frequency component (or each frequency group) in the frequency domain to determine the L-channel signal and the R-channel signal (refer to, for example, Non-Patent Literature 2).

If panning gain coefficients are used as encoding parameters of parametric stereo, scalable encoding (monaural-stereo scalable encoding) of a stereo signal can be done (refer to, for example, Patent Literatures 1 and 2). The panning gain coefficients are described in Patent Literature 1 as balance parameters and are described in Patent Literature 2 as ILDs (level differences).

In a mobile communication system, in order to make effective use of radio spectrum resources, a technique exists as intermittent transmission (DTX: discontinuous transmission) exists (refer to, for example, Non-Patent Literature 3). The DTX technique is a technique that, when speech is not emitted, information representing background noise is intermittently transmitted at an ultra-low bit rate. This enables reduction of the average bit rate during a conversation, and also accommodation of more mobile terminals with the same frequency band.

For example, in Non-Patent Literature 3, at a rate of one time every eight frames in a frame that is judged to be a non-speech section (inactive speech section, background noise section), LPC (linear prediction coding) coefficients are quantized by 29 bits (for example, by converting LPC coefficients to LSF (line spectral frequency) coefficients, and the frame energy is quantized by 6 bits, making a total of 35 bits (bit rate: 1.75 kbits/s). In the decoding section, ten pulses per frame generated based on random numbers are multiplied by the decoded frame energy, and the result is passed through a synthesis filter constituted by the decoded LPC coefficients to generate a decoded signal. This decoding processing is performed, while updating the LPC coefficients and the frame energy every eight frames.

CITATION LIST

Patent Literature

PTL 1
Japanese Translation of a PCT Application Laid-Open No. 2004-535145
PTL 2
Japanese Translation of a PCT Application Laid-Open No. 2005-533271

Non-Patent Literature

NPL 1
V. Pulkki and M. Karjalainen, "Localization of amplitude-panned virtual sources I: Stereophonic panning," Journal of the Audio Engineering Society, Vol. 49, No. 9, September 2001, pp. 739-752.
NPL 2
B. Cheng, C. Ritz and I. Burnett, "Principles and analysis of the squeezing approach to low bit rate spatial audio coding," proc. IEEE ICASSP2007, pp. I-13-I-16, April 2007.
NPL 3
3GPP TS 26.092 V4.0.0, "AMR Speech Codec: Comfort noise aspects (Release 4)," May 2001.

SUMMARY OF INVENTION

Technical Problem

Consider the case of applying an intermittent transmission technique to a stereo signal. In the above-noted conventional art, when panning coefficients are used with respect to the spectral profile of a background noise signal, because sub-bands are multiplied by panning coefficients, there is a problem that energy steps occurring in the spectra between sub-bands reduce the quality. This problem becomes prominent with a simple background noise signal, compared with a speech spectral profile. Although narrowing the width of the sub-bands to suppress the occurrence of energy steps can be envisioned as a method of solving this problem, the number of panning coefficients that must be transmitted from the encoder side to the decoder side increases, resulting in an increase in the bit rate.

In contrast, if the spectral profile of the background noise signal is represented by LPC coefficients, the above-noted energy steps do not occur in the spectrum. However, it is necessary to encode the LPC coefficients for both the L channel and the R channel, this resulting in the problem of an increased bit rate.

An object of the present invention is to provide a stereo signal encoding apparatus, a stereo signal decoding apparatus, a stereo signal encoding method, and a stereo signal decoding method that enable a reduction of the bit rate, without reducing the quality when an intermittent transmission technique is applied to a stereo signal.

Solution to Problem

A stereo signal encoding apparatus according to an embodiment of the present invention encodes a stereo signal having a first channel signal and a second channel signal; the stereo signal encoding apparatus adapts a constitution of comprising: a first encoding section that generates first encoded stereo data by encoding the stereo signal when the stereo signal of the current frame is a speech part; a second encoding section that encodes the stereo signal when the stereo signal of the current frame is a non-speech part and that generates second encoded stereo data by encoding each of: monaural signal spectral parameters that are spectral parameters of a monaural signal generated using the first channel signal and the second channel signal; first channel signal information regarding the amount of variation between the spectral parameters of the monaural signal and the spectral parameters of the first channel signal; and second channel signal information regarding the amount of variation between the spectral parameters of the monaural signal and the spectral parameters of the second channel signal; and a transmitting section that transmits the first encoded stereo data or the second encoded stereo data.

A stereo signal decoding apparatus adapts a constitution of comprising: a receiving section that obtains first encoded stereo data to be generated when a stereo signal having a first channel signal and a second channel signal is a speech part in an encoding apparatus or second encoded stereo data to be generated when the stereo signal is a non-speech part in the encoding apparatus; a first decoding section that obtains a first decoded stereo signal by decoding the first encoded stereo data; and a second decoding section that decodes the second encoded stereo data, obtaining a second decoded stereo signal having a first decoded channel signal and a second decoded channel signal, using monaural signal spectral parameters that are spectral parameters of a monaural signal obtained from encoded data generated using the first channel signal and the second channel signal, the first channel signal and the second channel signal being obtained from encoded data included in the second encoded stereo data, first channel signal information regarding the amount of variation between the spectral parameters of the monaural signal and the spectral parameters of the first channel signal, and second channel signal information regarding the amount of variation between the spectral parameters of the monaural signal and the spectral parameters of the second channel signal.

A stereo signal encoding method according to an embodiment of the present invention encodes a stereo signal having a first channel signal and a second channel signal; the stereo signal encoding method has a first encoding step of generating first encoded stereo data by encoding the stereo signal when the stereo signal of the current frame is a speech part; a second encoding step of encoding the stereo signal when the stereo signal of the current frame is a non-speech part and of generating second encoded stereo data by encoding each of: monaural signal spectral parameters that are spectral parameters of a monaural signal generated using the first channel signal and the second channel signal; first channel signal information regarding the amount of variation between the spectral parameters of the monaural signal and the spectral parameters of the first channel signal; and second channel signal information regarding the amount of variation between the spectral parameters of the monaural signal and the spectral parameters of the second channel signal; and a transmitting step of transmitting the first encoded stereo data or the second encoded stereo data.

A stereo signal decoding method according to an embodiment of the present invention has a receiving step of obtaining first encoded stereo data to be generated when a stereo signal having a first channel signal and a second channel signal is a speech part in an encoding apparatus or second encoded stereo data to be generated when the stereo signal is a non-speech part in the encoding apparatus; a first decoding step of obtaining a first decoded stereo signal by decoding the first encoded stereo data; and a second decoding step of decoding the second encoded stereo data. obtaining a second decoded stereo signal having a first decoded channel signal and a second decoded channel signal, using monaural signal spectral parameters that are spectral parameters of a monaural signal generated using the first channel signal and the second channel signal, the first channel signal and the second channel signal being obtained from encoded data included in the second encoded stereo data, first channel signal information regarding the amount of variation between the spectral parameters of the monaural signal and the spectral parameters of the first channel signal, and second channel signal information regarding the amount of variation between the spectral parameters of the monaural signal and the spectral parameters of the second channel signal.

Advantageous Effects of Invention

According to the present invention, in applying an intermittent transmission technique to a stereo signal, the bit rate can be reduced, without reducing the quality.

DESCRIPTION OF EMBODIMENTS

Embodiments of the present invention will now be described in detail, with reference to the accompanying drawings.

Embodiment 1

Figure 1:
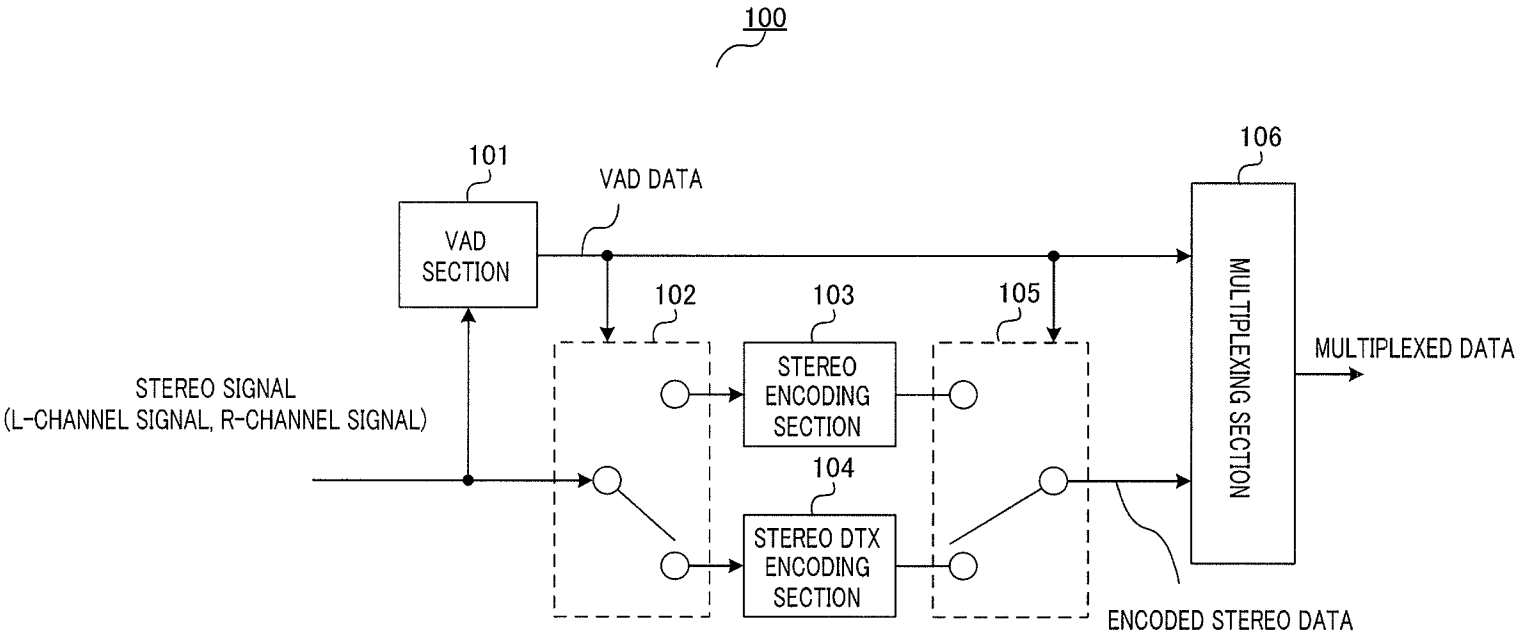
FIG. 1 is a block diagram showing the constitution of a stereo signal encoding apparatus according to Embodiment 1 of the present invention.

FIG. 1 is a block diagram showing the constitution of stereo signal encoding apparatus 100 according to Embodiment 1 of the present invention.

Stereo signal encoding apparatus 100 is mainly constituted by VAD (voice active detector) section 101, switching sections 102 and 105, stereo encoding section 103, stereo DTX encoding section 104, and multiplexing section 106. Stereo signal encoding apparatus 100 forms frames of a stereo signal at a prescribed time interval (for example, 20 ms), and encodes the stereo signal in units of the frames. Each of the constituent elements will be described in detail below.

VAD section 101 analyzes an input signal (a stereo signal formed by an L-channel signal and an R-channel signal) and judges whether the input signal of the current frame is a speech part or a non-speech part. A non-speech part corresponds to an inactive speech part, which, because the signal amplitude value is extremely small, is sensed as inactive speech by the sense of hearing, a background noise part or the like, which is typified by environmental sounds that are perceived in everyday life (operation sounds of ducts or the traveling sounds of vehicles), or the like. In the following, a background noise part will be described as a typical non-speech part. In this analysis, at least the signal energy is used. As a result of the analysis, if VAD section 101 judges the input signal of the current frame to be a speech part, it generates VAD data indicating that the input signal of the current frame is a speech part, and if VAD section 101 judges the input signal of the current frame to be a background noise part, it generates VAD data indicating that the input signal of the current frame is a background noise part. VAD section 101 outputs the generated VAD data to switching sections 102 and 105 and to multiplexing section 106.

Switching section 102, in accordance with the VAD data input from VAD section 101, switches the output destination of the input signal (stereo signal) between stereo signal encoding section 103 and stereo DTX encoding section 104. Specifically, if the VAD data indicates a speech part, switching section 102 switches the output destination to stereo encoding section 103 and outputs the input signal to stereo encoding section 103. If, however, the VAD data indicates a background noise part, switching section 102 switches the output destination to stereo DTX encoding section 104 and outputs the input signal to stereo DTX encoding section 104.

Stereo encoding section 103 encodes the input signal (speech part) input from switching section 102. Specifically, stereo encoding section 103 uses the correlation between the L-channel signal and the R-channel signal that constitute the stereo signal to encode the stereo signal. The method indicated in Non-Patent Literature 1, for example, is used as the method of encoding the above-noted stereo signal. Stereo encoding section 103 outputs the encoded stereo data generated by encoding processing to switching section 105.

Stereo DTX encoding section 104 encodes the input signal (background noise part) input from switching section 102. For example, stereo DTX encoding section 104 performs encoding processing one time for each prescribed number of frames (for example, eight frames). This is because it is assumed that there is little time variation of the characteristics of background noise. As a result, the bit rate can be further reduced. Stereo DTX encoding section 104 outputs the encoded stereo data generated by encoding processing to multiplexing section 106, via switching section 105. For frames for which encoding processing does not operate, stereo DTX encoding section 104 outputs to switching section 105 an SID that is a specific code (for example, silence description) indicating that encoding processing has not been done as encoded stereo data. The encoding processing in stereo DTX encoding section 104 will be described later in detail.

Switching section 105, similar to switching section 102, in accordance with the VAD data input from VAD section 101, switches the input source of the encoded stereo data between stereo encoding section 103 and stereo DTX encoding section 104. Specifically, if the VAD data indicates a speech part, switching section 105 switches the input source to stereo encoding section 103, and outputs the encoded stereo data generated by the stereo encoding section 103 to multiplexing section 106. If, however, the VAD data indicates a background noise part, switching section 105 switches the input source to stereo DTX encoding section 104, and outputs the encoded stereo data generated by the stereo DTX encoding section 104 to multiplexing section 106.

Multiplexing section 106 multplexes the VAD data input from VAD section 101 and the encoded stereo data input from switching section 105 to generate multiplexed data. By doing this, the multiplexed data is transmitted to the stereo signal decoding apparatus.

The above completes the description of the constitution of stereo signal encoding apparatus 100.

Figure 2:
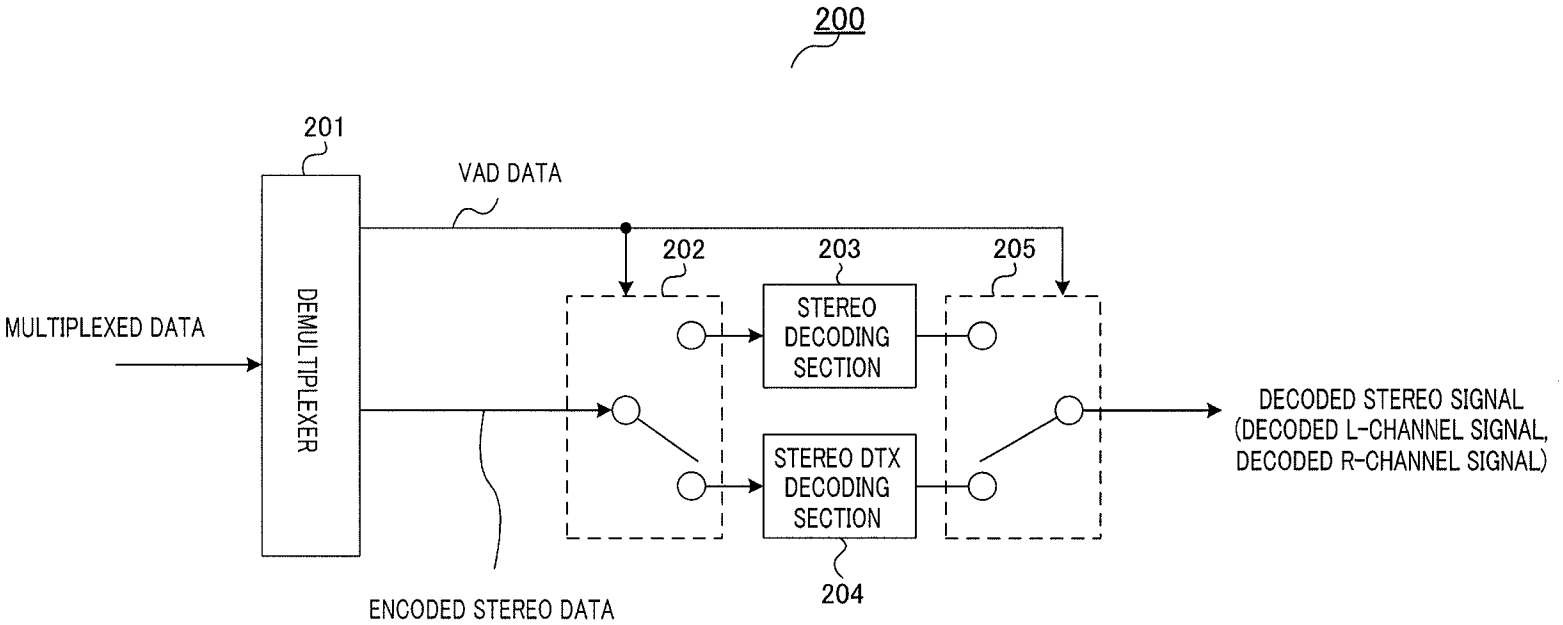
FIG. 2 is a block diagram showing the constitution of a stereo signal decoding apparatus according to Embodiment 1 of the present invention.

Next, a stereo signal decoding apparatus 200 according to the present embodiment will be described, using FIG. 2, which is a block diagram showing the constitution of stereo signal decoding apparatus 200.

Stereo signal decoding apparatus 200 is mainly constituted by demultiplexing section 201, switching sections 202 and 205, stereo decoding section 203, and stereo DTX decoding section 204. Each of the constituent elements will be described in detail below.

Demultplexing section 201 receives the input multiplexed data, and demultiplexes it into VAD data and encoded stereo data. Demultipexing section 201 outputs the VAD data to switching sections 202 and 205 and outputs the encoded stereo data to switching section 202.

In accordance with the VAD data (data indicating that the input signal of the current frame is either a speech part or a background noise part) input from demultipexing section 201, switching section 202 switches the output destination of the encoded stereo data between stereo decoding section 203 and stereo DTX decoding section 204. Specifically, if the VAD data indicates a speech part, switching section 202 switches the output destination to stereo decoding section 203 and outputs the encoded stereo data to stereo decoding section 203. If, however, the VAD data indicates a background noise part, switching section 202 switches the output destination to stereo DTX decoding section 204 and outputs the encoded stereo data to stereo DTX decoding section 204.

Stereo decoding section 203 decodes the encoded stereo data input from switching section 202 (that is, the encoded stereo data generated in stereo signal encoding apparatus 100 when the stereo signal is a speech part) to generate a decoded stereo signal (decoded L-channel signal and decoded R-channel signal). Stereo decoding section 203 then outputs the generated decoded stereo signal to switching section 205.

Stereo DTX decoding section 204 decodes the encoded stereo data input from switching section 202 (that is, the encoded stereo data generated in stereo signal encoding apparatus 100 when the stereo signal is a background noise part) to generate a decoded stereo signal (decoded L-channel signal and decoded R-channel signal). Stereo DTX decoding section 204 then outputs the generated decoded stereo signal to switching section 205. As described above, because stereo DTX encoding section 104 (FIG. 1) performs encoding processing at a rate of one time each prescribed number of frames (for example, eight frames), stereo DTX decoding section 204 receives the encoded stereo data at a rate of one time every prescribed number of frames (for example, eight frames), and receives SID (silence description) for other frames, that is, frames for which the encoding processing did not operate. Upon receiving the SID, stereo DTX decoding section 204 uses the recently received encoded stereo data to perform decoding processing to generate a decoded stereo signal. That is, stereo DTX decoding section 204 uses the received encoded stereo data continuously for a prescribed number of frames (for example, eight frames). The decoding processing in stereo DTX decoding section 204 will be described later in detail.

Switching section 205, similar to switching section 202, in accordance with the VAD data input from demultipexing section 201, switches the input source of the decoded stereo signal between stereo decoding section 203 and stereo DTX decoding section 204. Specifically, if the VAD data indicates a speech part, switching section 205 switches the input source to stereo decoding section 203 and outputs the decoded stereo signal generated by the stereo decoding section 203. If, however, the VAD data indicates a background noise part, switching section 205 switches the input source to stereo DTX decoding section 204 and outputs the decoded stereo signal generated by stereo DTX decoding section 204.

The above completes the description of the constitution of stereo signal decoding apparatus 200.

Next, the constitution of stereo DTX encoding section 104 in stereo signal encoding apparatus 100 will be described, using FIG. 3. In the following description, LSP (line spectral pair) parameters are assumed to be used as the spectral parameters for each signal. For example, the LSP parameters of the signals are determined by converting the LPC coefficients obtained by LPC analysis of the signals. However, the spectral parameters that are used are not restricted to being the LSP parameter, and may be LSF (line spectral frequency) parameters, ISF (immitance spectral frequency) parameters, or the like.

Figure 3:
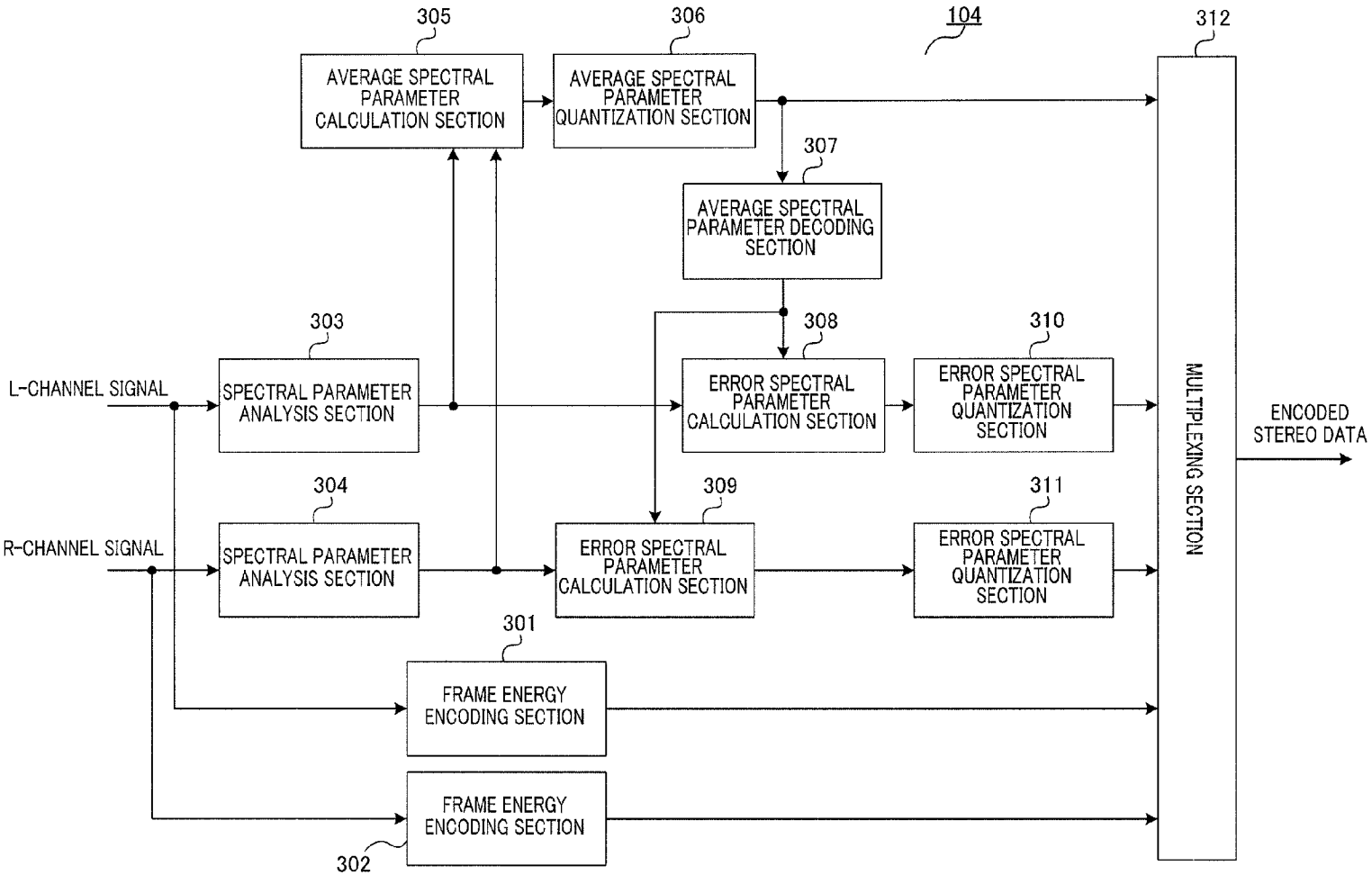
FIG. 3 is a block diagram showing the internal constitution of a stereo DTX encoding section according to Embodiment 1 of the present invention.

FIG. 3 is a block diagram showing the internal constitution of stereo DTX encoding section 104.

Stereo DTX encoding section 104 is mainly constituted by frame energy encoding sections 301 and 302, spectral parameter analysis sections 303 and 304, average spectrum parameter calculation section 305, average spectral parameter quantization section 306, average spectral parameter decoding section 307, error spectral parameter calculation sections 308 and 309, error spectral parameter quantization sections 310 and 311, and multiplexing section 312. Each of the constituent elements will be described in detail below.

Frame energy encoding section 301 determines the frame energy of the input L-channel signal and generates quantized L-channel signal frame energy information by performing scalar quantization (encoding) of the frame energy. Frame energy encoding section 301 then outputs the quantized L-channel signal frame energy information to multiplexing section 312.

Frame energy encoding section 302 determines the frame energy of the input R-channel signal and generates quantized R-channel signal frame energy information by performing scalar quantization (encoding) of the frame energy. Frame energy encoding section 302 then outputs the quantized R-channel signal frame energy information to multiplexing section 312.

Spectral parameter analysis section 303 performs LPC analysis of the input L-channel signal to generate LSP parameters indicating the spectral characteristics of the L-channel signal. Spectral parameter analysis section 303 then outputs the L-channel signal LSP parameters to average spectral parameter calculation section 305 and error spectral parameter calculation section 308.

Spectral parameter analysis section 304, similar to spectral parameter analysis section 303, performs LPC analysis of the input R-channel signal to generate LSP parameters indicating the spectral characteristics of the R-channel signal. Spectral parameter analysis section 304 then outputs the R-channel signal LSP parameters to average spectral parameter calculation section 305 and error spectral parameter calculation section 309.

Average spectral parameter calculation section 305 calculates the average spectral parameters, using the L-channel signal LSP parameters and the R-channel signal LSP parameters. Average spectral parameter calculation section 305 then outputs the average spectral parameters to average spectral parameter quantization section 306.

For example, average spectral parameter calculation section 305 calculates the average spectral parameters $LSP_m(i)$ in accordance with the following Equation (1).

[Eq. 1]

$$LSP_m(i) = \frac{1}{2}(LSP_L(i) + LSP_R(i)) \quad i = 0, \ldots, N_{LSP} - 1 \tag{1}$$

In the above, $LSP_L(i)$ indicates the LSP parameters of the L-channel signal, $LSP_R(i)$ indicates the LSP parameters of the R-channel signal, and $N_{LSP}$ indicates the order of the LSP parameters.

Average spectral parameter calculation section 305 may calculate the average spectral parameters based on the L-channel signal energy and the R-channel signal energy, as shown in the following Equation (2).

[Eq. 2]

$$LSP_m(i) = \frac{1}{2}(w \cdot LSP_L(i) + (1 - w)LSP_R(i)) \quad i = 0, \ldots, N_{LSP} - 1 \tag{2}$$

In the above, w indicates weighting that is determined based on the L-channel signal energy $E_L$ and the R-channel signal energy $E_R$, and set with respect to the calculated average spectral parameters $LSP_m(i)$ so that the influence of LSP parameters for the channel having a large energy becomes large. For example, w is calculated by the following Equation (3).

[Eq. 3]

$$w = E_L/(E_L + E_R) \tag{3}$$

Stated differently, average spectral parameter calculation section 305 calculates the average of the L-channel signal LSP parameters and the R-channel signal LSP parameters as the LSP parameters of a monaural signal generated from the L-channel signal and the R-channel signal. Average spectral parameter calculation section 305 may down-mix the L-channel signal and the R-channel signal to generate a monaural signal and take the LSP parameters calculated from this monaural signal (monaural signal LSP parameters) as the average spectral parameters.

Average spectral parameter quantization section 306, based on vector quantization, scalar quantization, or a quantization method that is a combination thereof, quantizes (encodes) the average spectral parameters. Average spectral parameter quantization section 306 outputs the quantized average spectral parameter information determined by quantization processing to average spectral parameter decoding section 307 and multiplexing section 312.

Average spectral parameter decoding section 307 decodes the quantized average spectral parameter information (that is, the encoded data of the average spectral parameters) to generate decoded average spectral parameters. Average spectral parameter decoding section 307 then outputs the decoded average spectral parameters to error spectral parameter calculation sections 308 and 309.

Error spectral parameter calculation section 308 subtracts the decoded average spectral parameters from the L-channel signal LSP parameters to calculate the L-channel signal error spectral parameters. Error spectral parameter calculation section 308 then outputs the L-channel signal error spectral parameters to error spectral parameter quantization section 310.

Error spectral parameter calculation section 309 subtracts the decoded average spectral parameters from the R-channel signal LSP parameters to calculate the R-channel signal error spectral parameters. Error spectral parameter calculation section 309 then outputs the R-channel signal error spectral parameters to error spectral parameter quantization section 311.

Error spectral parameter quantization section 310, based on vector quantization, scalar quantization, or a quantization method that is a combination thereof, quantizes (encodes) the L-channel signal error spectral parameters. Error spectral parameter quantization section 310 then outputs the quantized L-channel signal error spectral parameter information to multiplexing section 312.

Error spectral parameter quantization section 311, similar to the error spectral parameter quantization section 310, quantizes (encodes) the R-channel signal error spectral parameters. Error spectral parameter quantization section 311 then outputs the quantized R-channel signal error spectral parameter information to multiplexing section 312.

Multiplexing section 312 multiplexes the quantized L-channel signal frame energy information, the quantized R-channel signal frame energy information, the quantized average spectral parameter information, the quantized L-channel signal error spectral parameter information, and the quantized R-channel signal error spectral parameter information to generate encoded stereo data. Multiplexing section 312 then outputs the encoded stereo data to switching section 105 (FIG. 1). In stereo DTX encoding section 104, the multiplexing section 312 is not an essential constituent element. For example, quantized L-channel signal frame energy information, the quantized R-channel signal frame energy information, the quantized average spectral parameter information, the quantized L-channel signal error spectral parameter information, and the quantized R-channel signal error spectral parameter information may be directly output as encoded stereo data to switching section 105 (FIG. 1) from the constituent elements that generate each of the data.

The above completes the description of the constitution of stereo DTX encoding section 104.

Figure 4:
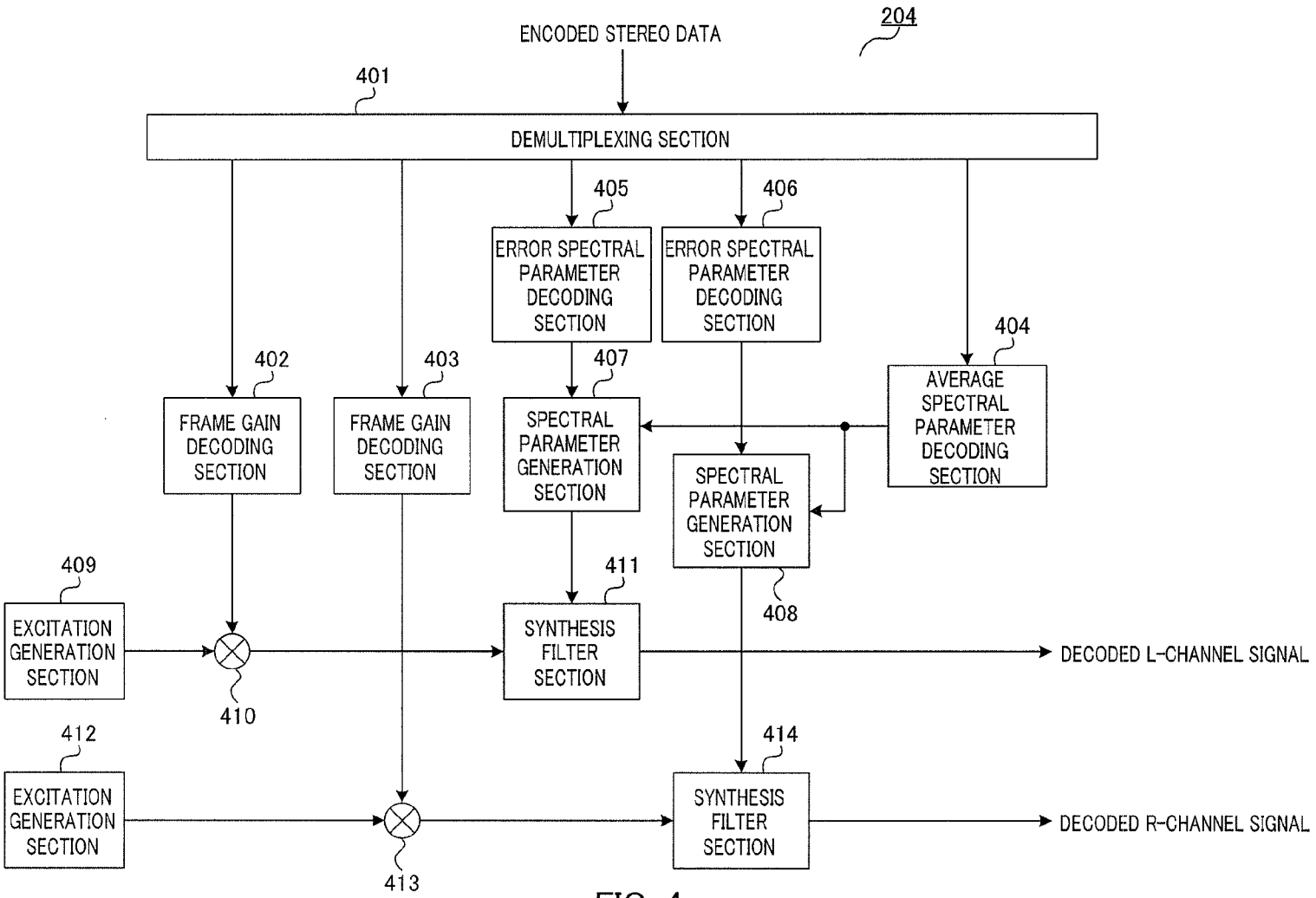
FIG. 4 is a block diagram showing the internal constitution of a stereo DTX decoding section according to Embodiment 1 of the present invention.

Next, the constitution of stereo DTX decoding section 204 in stereo signal decoding apparatus 200 will be described, using FIG. 4, which is a block diagram showing the internal constitution of stereo DTX decoding section 204.

Stereo DTX decoding section 204 is mainly constituted by demultiplexing section 401, frame gain decoding sections 402 and 403, average spectral parameter decoding section 404, error spectral parameters decoding sections 405 and 406, spectral parameter generation sections 407 and 408, excitation generation sections 409 and 412, multiplication sections 410 and 413, and synthesis filter sections 411 and 414. Each of the constituent elements will be described in detail below.

Demultiplexing section 401 demultiplexer the encoded stereo data input from switching section 202 (FIG. 2) into the quantized L-channel signal frame energy information, the quantized R-channel signal frame energy information, the quantized average spectral parameter information, the quantized L-channel signal error spectral parameter information, and the quantized R-channel signal error spectral parameter information. Demultiplexing section 401 then outputs the quantized L-channel signal frame energy information to frame gain encoding section 402, the quantized R-channel signal frame information to frame gain encoding section 403, the quantized average spectral parameter information to average spectral parameter decoding section 404, the quantized L-channel signal error spectral parameter information to error spectral parameter decoding section 405, and the quantized R-channel signal error spectral parameter information to error spectral parameter decoding section 406.

In stereo DTX decoding section 204, demultiplexing section 401 is not an essential constituent element. For example, by the demultiplexing processing in demultiplexing section 201 shown in FIG. 2, the quantized L-channel signal frame energy information, the quantized R-channel signal frame energy information, the quantized average spectral parameter information, the quantized L-channel signal error spectral parameter information, and the quantized R-channel signal error spectral parameter information may be obtained and each of these data may be directly output to frame gain decoding section 402 and 403, average spectral parameter decoding section 404, and error spectral parameter decoding section 405 and 406, respectively.

Frame gain decoding section 402 decodes the quantized L-channel signal frame energy information and outputs the obtained decoded L-channel signal frame energy to multiplication section 410.

Frame gain decoding section 403 decodes the quantized R-channel signal frame energy information and outputs the obtained decoded R-channel signal frame energy to multiplication section 413.

Average spectral parameter decoding section 404 decodes the quantized average spectral parameter information and outputs the obtained decoded average spectral parameters to spectral parameter generation sections 407 and 408.

Error spectral parameter decoding section 405 decodes the quantized L-channel signal error spectral parameter information and outputs the obtained decoded L-channel signal error spectral parameters to spectral parameter generation section 407.

Error spectral parameter decoding section 406 decodes the quantized R-channel signal error spectral parameter information and outputs the obtained decoded R-channel signal error spectral parameters to spectral parameter generation section 408.

Spectral parameter generation section 407 uses the decoded average spectral parameters and the decoded L-channel signal error spectral parameters to generate the decoded L-channel signal spectral parameters. Spectral parameter generation section 407 then converts the generated decoded L-channel signal spectral parameters to decoded L-channel signal LPC coefficients and outputs the obtained decoded L-channel signal LPC coefficients to synthesis filter section 411.

For example, spectral parameter generation section 407, in accordance with the following Equation (4), uses the decoded average spectral parameters $LSP_{qm}(i)$ and the decoded L-channel signal error spectral parameters $ELSP_{qL}(i)$ to generate the decoded L-channel signal spectral parameters $LSP_{qL}(i)$.

[Eq. 4]

$$LSPq_L(i)=LSPq_m(i)+ELSPq_L(i)i=0, \ldots, N_{LSP}-1 \quad (4)$$

Spectral parameter generation section 408 uses the decoded average spectral parameters and the decoded R-channel signal error spectral parameters to generate the decoded R-channel signal spectral parameters. Spectral parameter generation section 408 then converts the generated decoded R-channel signal spectral parameters to decoded R-channel signal LPC coefficients and outputs the obtained decoded R-channel signal LPC coefficients to synthesis filter section 414.

For example, spectral parameter generation section 408, in accordance with the following Equation (5), uses the decoded average spectral parameters $LSP_{qm}(i)$ and the decoded R-channel signal error spectral parameters $ELSP_{qR}(i)$ to generate the decoded R-channel signal spectral parameters $LSP_{qR}(i)$.

[Eq. 5]

$$LSPq_R(i)=LSPq_m(i)+ELSPq_R(i)i=0, \ldots, N_{LSP}-1 \quad (5)$$

Excitation generation section 409, multiplication section 410, and synthesis filter 411 are constituent elements corresponding to the L-channel signal.

Excitation generation section 409 generates an excitation signal represented by a random signal or a limited number of pulses and outputs the excitation signal to multiplication section 410. Normalization is done so that the frame energy of the excitation signal is 1.

Multiplication section 410 multiplies the excitation signal by the decoded L-channel signal frame energy and outputs the multiplication result to synthesis filter section 411.

Synthesis filter section 411 has a synthesis filter constituted by the decoded L-channel signal LPC coefficients input from spectral parameter generation section 407 and passes the multiplication result input from the multiplication section 410 (the excitation signal multiplied by the decoded L-channel signal frame energy) through the synthesis filter to generate a decoded L-channel signal. This decoded L-channel signal is output as the output signal.

Excitation generation section 412, multiplication section 413, and synthesis filter 414 are constituent elements corresponding to the R-channel signal.

Excitation generation section 412 generates an excitation signal represented by a random signal or a limited number of pulses and outputs the excitation signal to multiplication section 413. Normalization is done so that the frame energy of the excitation signal is 1.

Multiplication section 413 multiplies the excitation signal by the decoded R-channel signal frame energy and outputs the multiplication result to synthesis filter section 414.

Synthesis filter section 414 has a synthesis filter constituted by the decoded R-channel signal LPC coefficients input from spectral parameter generation section 408 and passes the multiplication result input from the multiplication section 413 (the excitation signal multiplied by the decoded R-channel signal frame energy) through the synthesis filter to generate a decoded R-channel signal. This decoded R-channel signal is output as the output signal.

In this manner, when the stereo signal of the current frame is a background noise part, stereo signal encoding apparatus 100 generates, as encoded stereo data, encoded average spectral data, which is the average of spectral parameters of the L-channel signal and the spectral parameters of the R-channel signal (that corresponds to the encoded data of the LPC coefficients of a monaural signal); encoded data of the varying component (error) between the average spectral parameters and the LSP parameters of the L-channel signal; and encoded data of the varying component (error) between the average spectral parameters and the LSP parameters of the R-channel signal.

That is, even if the spectral profile of the background noise signal is represented by LPC coefficients, rather than encoding the LPC coefficients of the L-channel signal and the LPC coefficients of the R-channel signal, in addition to the encoded data of the LPC coefficients of a monaural signal, stereo signal encoding apparatus 100 adds, as information added to the LPC coefficients of the monaural signal, the difference (amount of variation) between the LSP parameters of the monaural signal and the LSP parameters of the L-channel signal (information regarding the L-channel signal) and the difference (amount of variation) between the LSP parameters of the monaural signal and the LSP parameters of the R-channel signal (information regarding the R-channel signal). Stated differently, stereo signal encoding apparatus 100 uses the correlation between the LPC coefficients of the monaural signal and the LPC coefficients of the L-channel signal and the correlation between the LPC coefficients of the monaural signal and the LPC coefficients of the R-channel signal to encode the stereo signal.

Because it is sufficient to encode only the LPC coefficients of the monaural signal and added information regarding the monaural signal and each channel signal, the bit rate can be reduced, compared to the case of encoding LPC coefficients for two channels (L channel and R channel).

Also, when the stereo signal of the current frame is a background noise part, stereo signal decoding apparatus 200 obtains a decoded stereo signal that is made up of a decoded L-channel signal and a decoded R-channel signal, using encoded data of the average spectral parameters (that corresponds to the encoded data of the LPC coefficients of a monaural signal); encoded data of the varying component (error) between the average spectral parameters and the LSP parameters of the L-channel signal; and encoded data of the varying component (error) between the average spectral parameters and the LSP parameters of the R-channel signal, which are included in the encoded stereo data.

As a result, using the LPC coefficients of the monaural signal and the information added to the LPC coefficients of the monaural signal (varying component of LSP parameters of the monaural signal and the LSP parameters of each channel signal), the LPC coefficients of the L-channel signal and the LPC coefficients of the R-channel signal are obtained. This enables the achievement of the same quality as the case of receiving the LPC coefficients for two channels (L channel and R channel).

Thus, according to the present embodiment, in applying an intermittent transmission technique to a stereo signal, the bit rate can be reduced, without reducing the quality.

Embodiment 2

Figure 5:
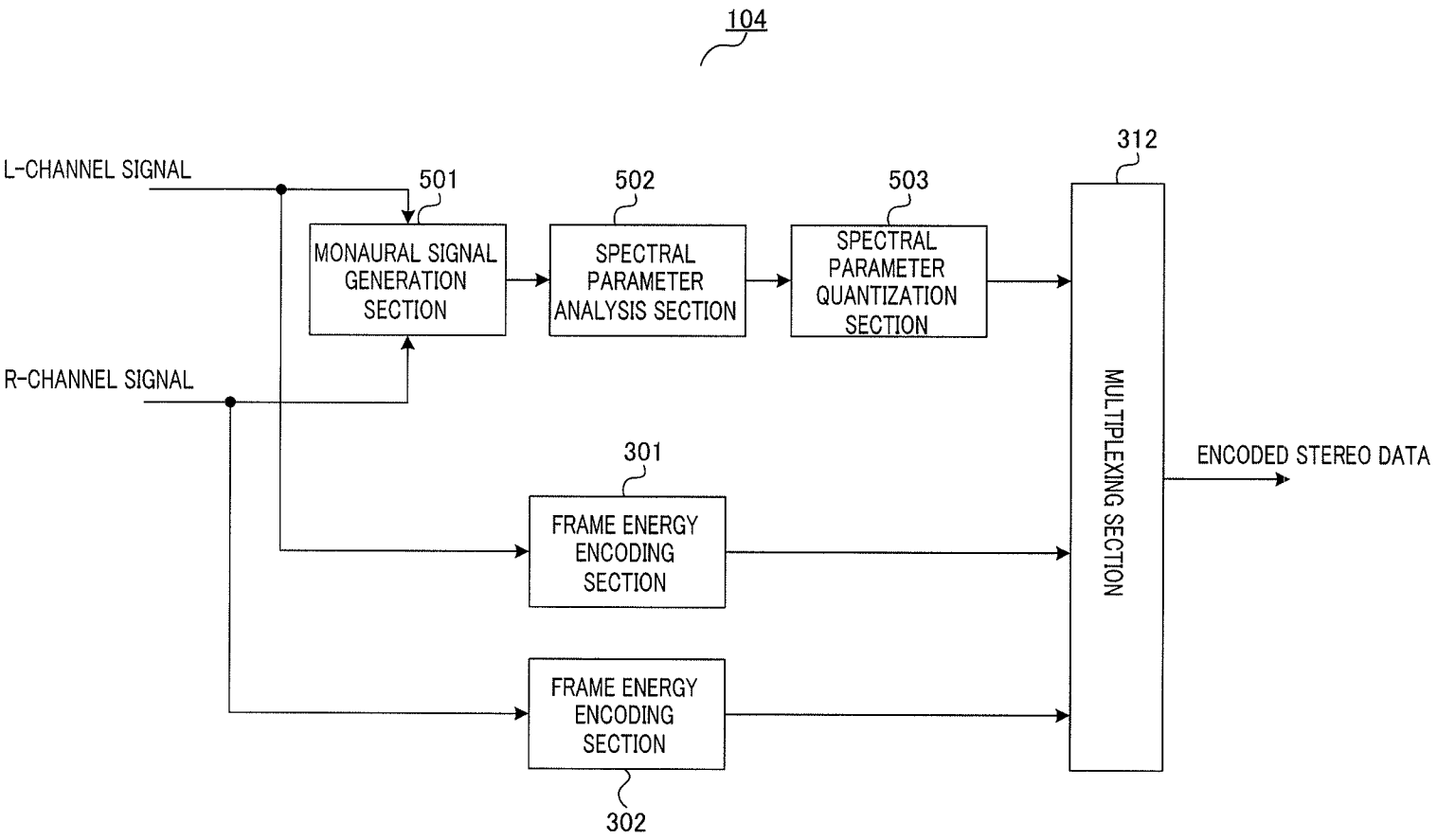
FIG. 5 is a block diagram showing the constitution of a stereo DTX encoding section according to Embodiment 2 of the present invention.

FIG. 5 is a block diagram showing the internal constitution of stereo DTX encoding section 104 of stereo signal encoding apparatus 100 (FIG. 1) according to Embodiment 2 of the present invention.

Stereo DTX encoding section 104 shown in FIG. 5 is mainly constituted by frame energy encoding sections 301 and 302, monaural signal generation section 501, spectral parameter analysis section 502, spectral parameter quantization section 503, and multiplexing section 312. Each of the constituent elements will be described below in detail. In FIG. 5, parts having the same constitution as in FIG. 3 are assigned the same reference signs, and the description thereof will be omitted.

Monaural signal generation section 501 down-mixes the L-channel signal and the R-channel signal making up a stereo signal to generate a monaural signal. Monaural signal generation section 501 then outputs the generated monaural signal to spectral parameter analysis section 502.

Spectral parameter analysis section 502 performs LPC analysis of the monaural signal to generate LSP parameters that indicate the spectral characteristics of the monaural signal. The LSP parameters of a monaural signal can be determined, for example, by converting the LPC coefficients obtained by analysis with respect to the monaural signal. Spectral parameter analysis section 502 then outputs the LSP parameters of the monaural signal to spectral parameter quantization section 503.

Spectral parameter quantization section 503, based on vector quantization, scalar quantization, or a quantization method that is a combination thereof, quantizes (encodes) the LSP parameters of the monaural signal. Spectral parameter quantization section 503 outputs the quantized monaural signal spectral parameter information determined by quantization processing to multiplexing section 312.

The above completes the description of the constitution of stereo DTX encoding section 104.

Next, the constitution of stereo DTX decoding section 204 of stereo signal decoding apparatus 200 (FIG. 2) of Embodiment 2 of the present invention will be described, using FIG. 6, which is a block diagram of the internal constitution of stereo DTX decoding section 204 according to Embodiment 2 of the present invention.

Figure 6:
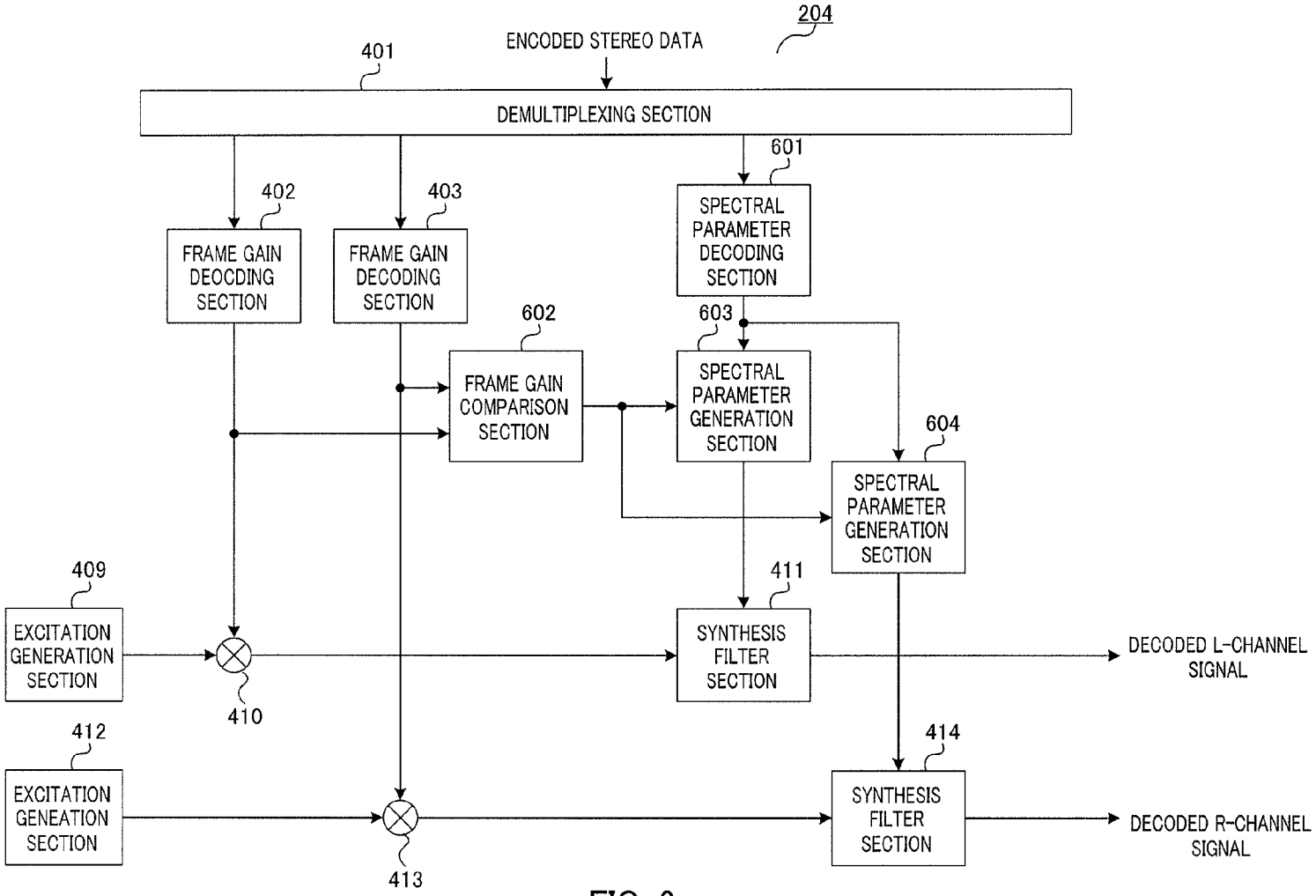
FIG. 6 is a block diagram showing the constitution of a stereo DTX decoding section according to Embodiment 2 of the present invention.

Stereo DTX decoding section 204 shown in FIG. 6 is mainly constituted by demultiplexing section 401, frame gain decoding sections 402 and 403, spectral parameter decoding section 601, frame gain comparison 602, spectral parameter generation sections 603 and 604, excitation generation sections 409 and 412, multiplication sections 410 and 413, and synthesis filter sections 411 and 414. Each of the constituent elements will be described below in detail. In FIG. 6, parts having the same constitution as in FIG. 4 are assigned the same reference signs, and the description thereof will be omitted.

Spectral parameter decoding section 601 decodes the quantized monaural signal spectral parameter information to obtain the monaural signal spectral parameters, and outputs the monaural signal spectral parameters to spectral parameter generation sections 603 and 604.

Frame gain comparison section 602 compares the decoded L-channel signal frame energy and the decoded R-channel signal frame energy and, in according to the comparison result, determines deformation coefficients for deforming at least one of the decoded L-channel signal LPC coefficients and the decoded R-channel signal LPC coefficients.

Spectral parameter generation section 603 converts the monaural signal spectral parameters to monaural signal LPC coefficients and calculates the decoded L-channel signal LPC coefficients (deformed LPC coefficients) to be used in the synthesis filter section 411, using the monaural signal LPC coefficients and the deformation coefficients corresponding to the L-channel signal.

Similar to spectral parameter generation section 603, spectral parameter generation section 604 converts the monaural signal spectral parameters to monaural signal LPC coefficients, and calculates the decoded R-channel signal LPC coefficients (deformed LPC coefficients) to be used in synthesis filter section 414, using the monaural signal LPC coefficients and the deformation coefficients corresponding to the R-channel signal.

In this manner, spectral parameter generation sections 603 and 604 calculate the decoded L-channel signal LPC coefficients and the decoded R-channel signal LPC coefficients to be used, respectively, in the synthesis filter sections 411 and 414, using the deformation coefficients obtained based on the comparison result at frame gain comparison section 602 and the monaural signal spectral parameters.

In this case, the description has been for the case in which it is the frame gain comparison section 602 that determines the deformation coefficients in accordance with the comparison result. This is not a restriction, however; for example, spectral parameter generation sections 603 and 604 may determine the deformation coefficients in accordance with the comparison result input from the frame gain comparison section 602.

For example, let the deformation coefficients for deforming the decoded L-channel signal LPC coefficients $LPC_L(i)$ be $\alpha_L$ and let the deformation coefficients for deforming the decoded R-channel signal LPC coefficients $LPC_R(i)$ be $\alpha_R$. In this case, it is assumed that $0.0 \le \alpha_L \le 1.0$ and $0.0 \le \alpha_R \le 1.0$. In this case, the synthesis filters $H_L(Z)$ and $H_R(Z)$ that correspond, respectively, to the L-channel signal and the R-channel signal are represented by the following Equation (6) and Equation (7).

[Eq. 6]

$$H_L(z) = \frac{1}{1 - \sum_{i=1}^{N_{LPC}} LPC_L(i) \cdot \alpha_L^i \cdot z^{-i}} \tag{6}$$

[Eq. 7]

$$H_R(z) = \frac{1}{1 - \sum_{i=1}^{N_{LPC}} LPC_R(i) \cdot \alpha_R^i \cdot z^{-i}} \tag{7}$$

In the above, $N_{LPC}$ is the order of the LPC coefficients. That is, the LPC coefficients of the signals of each channel are deformed by the deformation coefficients $\alpha$, as shown in Equations (6) and (7).

The deformation coefficients $\alpha_L$ and $\alpha_R$ may be formed, for example, by the method of using the following Equations (8).

[Eq. 8]

$$\begin{cases} \alpha_L = 1.0,\ \alpha_R = 0.8 & \text{if } \log_{10}\frac{E_L}{E_R} > 1.0 \\ \alpha_L = 1.0,\ \alpha_R = 1.0 & \text{if } -1.0 \le \log_{10}\frac{E_L}{E_R} \le 1.0 \\ \alpha_L = 0.8,\ \alpha_R = 1.0 & \text{if } \log_{10}\frac{E_L}{E_R} < -1.0 \end{cases} \tag{8}$$

The intention of this is to make the LPC coefficients of the channel having the smaller frame energy approach (flatten to) white noise.

Specifically, if the decoded L-channel signal frame energy $E_L$ is 10 dB larger than the decoded R-channel signal frame energy $E_R$ (upper line in Equation (8)), the decoded L-channel signal LPC coefficients $LPC_L(i)$ are not deformed ($\alpha_L$=1.0), and the decoded R-channel signal LPC coefficients $LPC_R(i)$ are made smaller ($\alpha_R$=0.8). That is, deformation is applied in the direction that increases the degree of making the decoded R-channel signal LPC coefficients $LPC_R(i)$ white.

If, however, the decoded R-channel signal frame energy $E_R$ is 10 dB larger than the decoded L-channel signal frame energy $E_L$ (lower line in Equation (8)), the decoded R-channel signal LPC coefficients $LPC_R(i)$ are not deformed ($\alpha_R$=1.0), and the decoded L-channel signal LPC coefficients $LPC_L(i)$ are made smaller ($\alpha_L$=0.8). That is, deformation is applied in the direction that increases the degree of making the decoded L-channel signal LPC coefficients $LPC_L(i)$ white.

That is, if the difference between the decoded L-channel signal frame energy and the decoded R-channel signal frame energy exceeds a threshold (in this case, 10 dB), stereo DTX decoding section 204 applies deformation to the LPC coefficients of the channel signal having the smaller frame energy between the decoded L-channel signal LPC coefficients and the decoded R-channel signal coefficients in the direction that increases the degree of making those LPC coefficients white.

In cases other than the above (that is, if the energy difference is within 10 dB, shown by the middle line in Equation (8)), the LPC coefficients of neither channel signal are deformed ($\alpha_L$=$\alpha_R$=1.0).

The method of determining the above-noted deformation coefficients $\alpha_L$ and $\alpha_R$ is based on the following idea.

It is possible to judge that, compared to the channel having a large frame energy, the channel having a small frame energy is farther away from the source of the background noise. When the distance from the source of background noise becomes large, there is a tendency to be influenced by external perturbation (for example, reflection from a wall or other noise) from the source up until reaching the microphone, so that the spectrum approaches white noise. Thus, even if added information representing the L-channel signal LPC coefficients and the R-channel signal LPC coefficients is not encoded at the encoder side, by making the LPC coefficients of the channel having small frame energy (the channel that is distant from the source of the background noise) approach white (flatten), high-quality background noise can be generated.

Figure 7:
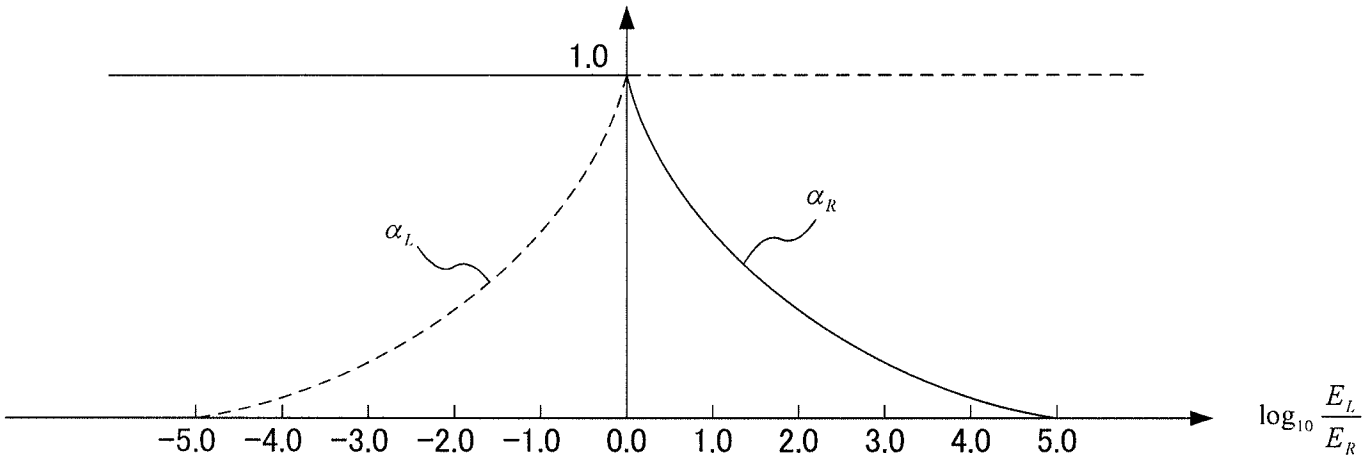
FIG. 7 is a drawing showing the relationship of correspondence of the frame energy difference between the channels and deformation coefficients for each channel according to Embodiment 2 of the present invention.

Finer setting can be made of this correspondence between the frame energy and the LPC coefficients (deformation coefficients). FIG. 7 shows an example of the correspondence between the frame energy and the LPC coefficients (deformation coefficients). In FIG. 7, the broken line shows the value of the deformation coefficients $\alpha_L$ (the range from 0.0 to 1.0) and the solid line shows the value of the deformation coefficients $\alpha_R$ (the range from 0.0 to 1.0).

As shown in FIG. 7, the larger the decoded L-channel signal frame energy $E_L$ is with respect to the decoded R-channel signal frame energy $E_R$ (the larger $\log_{10}(E_L/E_R)$ is), the greater is the deformation that increases making the decoded R-channel signal LPC coefficients white (that is, the smaller the deformation coefficients $\alpha_R$ are made).

In contrast, the larger the decoded R-channel signal frame energy $E_R$ is with respect to the decoded L-channel signal frame energy $E_L$ (the smaller $\log_{10}(E_L/E_R)$ is), the greater is the deformation that increases making the decoded L-channel signal LPC coefficients white (that is, the smaller the deformation coefficients $\alpha_L$ are made).

That is, the larger is the difference between the decoded L-channel signal frame energy and the decoded R-channel signal frame energy, the stereo DTX decoding section 204 applies greater deformation to the LPC coefficients of the channel signal having the smaller frame energy between the decoded L-channel signal LPC coefficients and the decoded R-channel signal LPC coefficients, in the direction that increases the degree of making those LPC coefficients white.

Further, if the difference between the decoded L-channel signal frame energy $E_L$ and the decoded R-channel signal frame energy $E_R$ exceeds 50 dB, the LPC coefficients of the channel signal with the smaller frame energy becomes completely flat.

In this manner, in the present embodiment, stereo signal encoding apparatus 100 encodes the monaural signal LPC coefficients, the L-channel signal frame energy, and the R-channel signal frame energy. Then, based on the relationship between the frame energies of the received L-channel signal and R-channel signal, stereo signal decoding apparatus 200 deforms the LPC coefficients of the monaural signal so as to generate the decoded L-channel signal LPC coefficients and the decoded R-channel signal LPC coefficients.

That is, even if the spectral profile of the background noise signal is represented by LPC coefficients, rather than encoding the LPC coefficients of the L-channel signal and the LPC coefficients of the R-channel signal, in addition to the encoded data of the LPC coefficients of a monaural signal, stereo signal encoding apparatus 100 adds, as information added to the LPC coefficients of the monaural signal, the frame energy of the L-channel signal (information regarding the L-channel signal) and the frame energy of the R-channel signal (information regarding the R-channel signal).

If the present embodiment is compared to Embodiment 1, the encoded data of the frame energies of each channel signal are transmitted from the encoder side to the decoder in both embodiments. In the present embodiment, however, the encoded data of the frame energies of each channel signal is further used as information added to the monaural signal LPC coefficients. As a result, in the stereo signal decoding apparatus 100, it is not necessary to encode added information that is required to express the LPC coefficients of the channel signals (in Embodiment 1, varying components between the monaural signal LPC coefficients and LPC coefficients of each of the channel signals).

Stereo signal encoding apparatus 200 applies deformation to the LPC coefficients of the channel signal having the smaller frame energy between the channel signals constituting the stereo signal, in the direction that increases the degree of making those coefficients white. This enables generation of high-quality background noise, even if only the LPC coefficients of the monaural signal are received.

Thus, in the present embodiment, even when only the LPC coefficients of a monaural signal are transmitted, high-quality background noise can be generated, and also the bit rate can be reduced further, relative to Embodiment 1.

Embodiment 3

Figure 8:
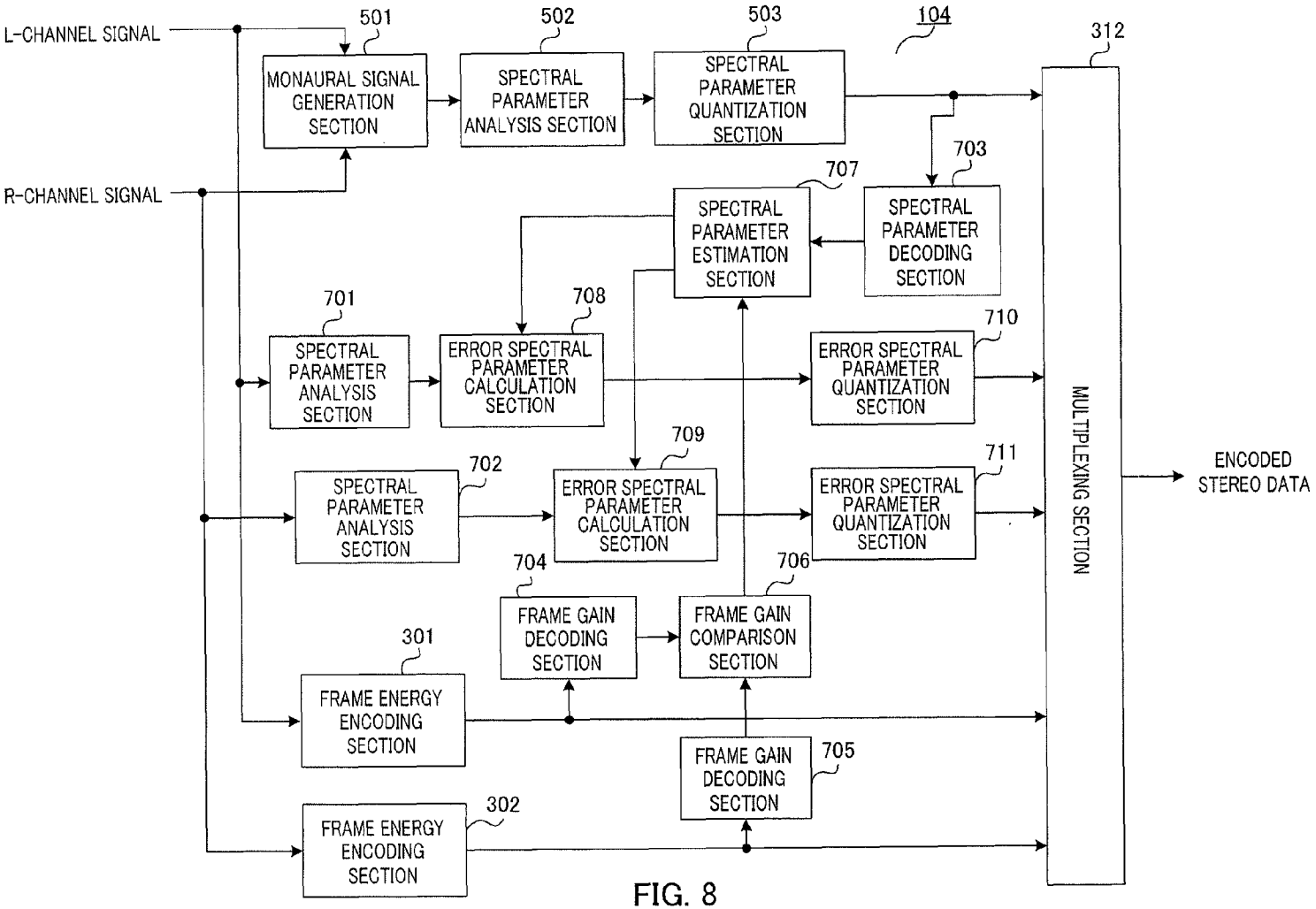
FIG. 8 is a block diagram showing the constitution of a stereo DTX encoding section according to Embodiment 3 of the present invention.

FIG. 8 is a block diagram showing the internal constitution of stereo DTX encoding section 104 of stereo signal encoding apparatus 100 (FIG. 1) according to Embodiment 3 of the present invention.

Stereo DTX encoding section 104 shown in FIG. 8 is mainly constituted by frame energy encoding sections 301 and 302, monaural signal generating section 501, spectral parameter analysis section 502, spectral parameter quantization section 503, spectral parameter analysis sections 701 and 702, spectral parameter decoding section 703, frame gain decoding sections 704 and 705, frame gain comparison section 706, spectral parameter estimation section 707, error spectral parameter calculation sections 708 and 709, error spectral parameter quantization sections 710 and 711, and multiplexing section 312. Each of the constituent elements will be described in detail below. In FIG. 8, parts having the same constitution as in FIG. 5 are assigned the same reference signs, and the description thereof will be omitted.

Spectral parameter analysis section 701 performs LPC analysis of the input L-channel signal, generates and outputs to error spectral parameter calculation section 708 LSP parameters indicating the spectral characteristics of the L-channel signal.

Spectral parameter analysis section 702 performs LPC analysis of the input R-channel signal, generates and outputs to error spectral parameter calculation section 709 LSP parameters indicating the spectral characteristics of the R-channel signal.

Spectral parameter decoding section 703 decodes the quantized monaural signal spectral parameter information input from spectral parameter quantization section 503, generates the monaural signal spectral parameters, and outputs the monaural signal spectral parameters to spectral parameter estimation section 707.

Frame gain decoding section 704 decodes the quantized L-channel signal frame energy information input from frame energy encoding section 301 and outputs the obtained decoded L-channel signal frame energy to frame gain comparison section 706.

Frame gain decoding section 705 decodes the quantized R-channel signal frame energy information input from frame energy encoding section 302 and outputs the obtained decoded R-channel signal frame energy to frame gain comparison section 706.

Frame gain comparison section 706 compares the decoded L-channel signal frame energy and the decoded R-channel signal frame energy. Then, frame gain comparison section 706, in accordance with the comparison result, determines the deformation coefficients for deforming at least one of the decoded L-channel signal LPC coefficients and the decoded R-channel signal LPC coefficients. Frame gain comparison section 706 outputs the determined deformation coefficients to spectral parameter estimation section 707. Because the method of determining the deformation coefficients has been described in Embodiment 2, the description thereof will be omitted.

Spectral parameter estimation section 707, using the monaural signal spectral parameters and the deformation coefficients, calculates the estimated L-channel signal spectral parameter and the estimated R-channel signal spectral parameters. Spectral parameter estimation section 707 outputs the calculated estimated L-channel signal spectral parameters to error spectral parameter calculation section 708 and outputs the estimated R-channel signal spectral parameters to error spectral parameter calculation section 709.

Spectral parameter estimation section 707 calculates the estimated L-channel signal spectral parameters and the estimated R-channel signal spectral parameters as indicated, for example, below.

First, spectral parameter estimation section 707 converts the monaural signal spectral parameters to determine monaural signal LPC coefficients. Then, spectral parameter estimation section 707 imparts deformation to the monaural signal LPC coefficients, using the L-channel deformation coefficients, to determine the deformed L-channel LPC coefficients. Because the method of deformation has already been described in Embodiment 2, the description thereof will be omitted. Spectral parameter estimation section 707 converts the deformed L-channel LPC coefficients determined in this manner to spectral parameters such as LSP parameters or LSF parameters, and outputs these as the estimated L-channel signal spectral parameters to error spectral parameter calculation section 708.

Spectral parameter estimation section 707 performs the same type of processing as the L channel with respect to the R channel as well. That is, spectral parameter estimation section 707 imparts deformation to the monaural signal LPC coefficients using the deformation coefficients for the R channel to determine the deformed R-channel LPC coefficients. Spectral parameter estimation section 707 converts the R-channel LPC coefficients to determine and output to error spectral parameter calculation section 709 the estimated R-channel signal spectral parameters.

Error spectral parameter calculation section 708 subtracts the estimated L-channel signal spectral parameters from the spectral parameters of the L-channel signal (LSP parameters of a L-channel signal) to calculate and output to error spectral parameter quantization section 710 the L-channel signal error spectral parameters.

Error spectral parameter calculation section 709 subtracts the estimated R-channel signal spectral parameters from the spectral parameters of the R-channel signal (LSP parameters of a R-channel signal) to calculate and output to error spectral parameter quantization section 711 the R-channel signal error spectral parameters.

Error spectral parameter quantization section 710, based on vector quantization, scalar quantization, or a quantization method that is a combination thereof, quantizes (encodes) the L-channel signal error spectral parameters. Error spectral parameter quantization section 710 outputs the quantized L-channel signal error spectral parameter information determined by quantization processing to multiplexing section 312.

Error spectral parameter quantization section 711, based on vector quantization, scalar quantization, or a quantization method that is a combination thereof, quantizes (encodes) the R-channel signal error spectral parameters. Error spectral parameter quantization section 711 outputs the quantized R-channel signal error spectral parameter information determined by quantization processing to multiplexing section 312.

Figure 9:
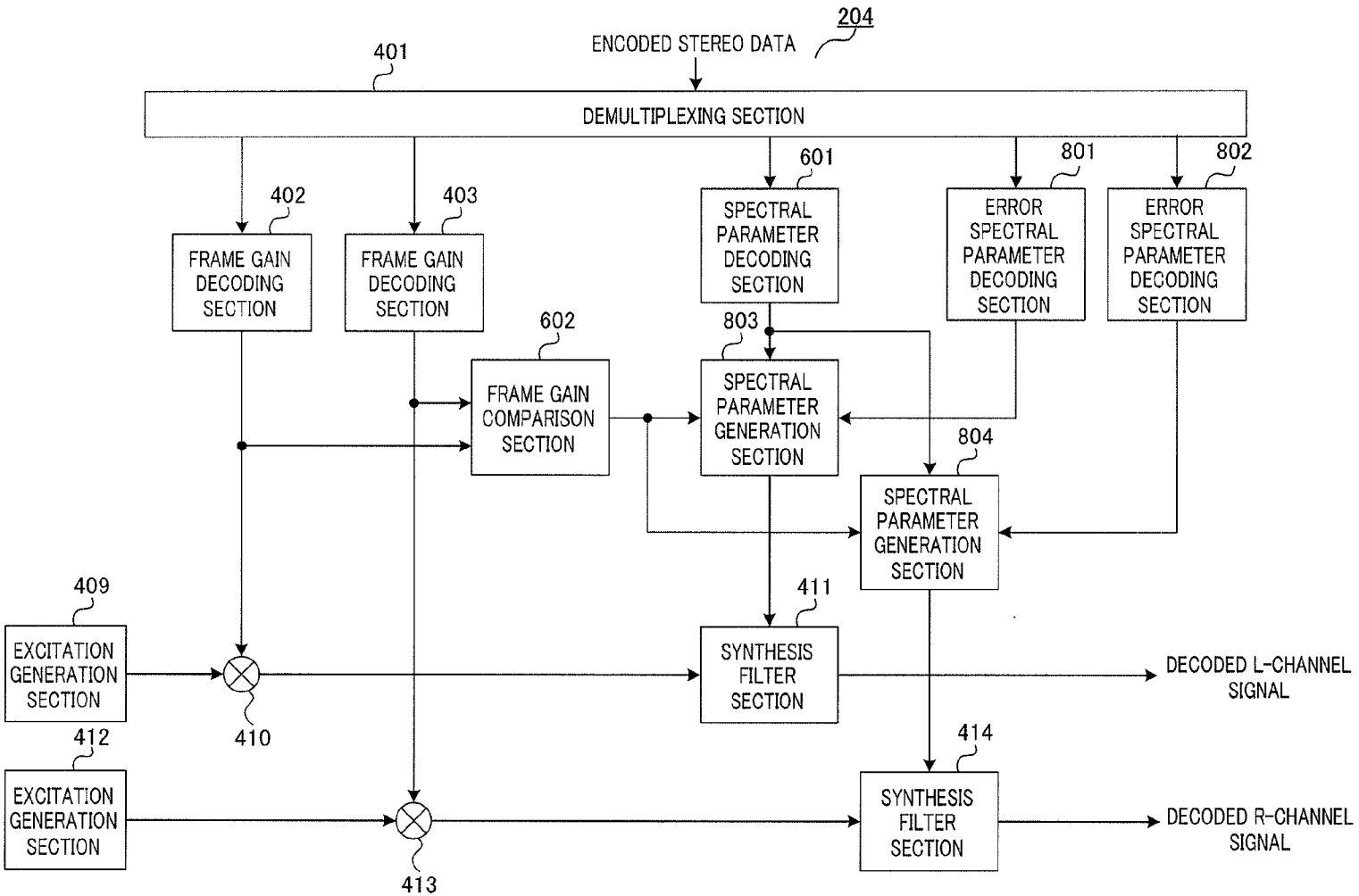
FIG. 9 is a block diagram showing the constitution of a stereo DTX decoding section according to Embodiment 3 of the present invention.

FIG. 9 is a block diagram showing the internal constitution of stereo DTX decoding section 204 of stereo signal decoding apparatus 200 (FIG. 2) according to Embodiment 3 of the present invention.

Stereo DTX decoding section 204 shown in FIG. 9 is mainly constituted by demultiplexing section 401, frame gain decoding sections 402 and 403, spectral parameter decoding section 601, error spectral parameter decoding sections 801 and 802, frame gain comparison section 602, spectral parameter generation sections 803 and 804, excitation generation sections 409 and 412, multiplication sections 410 and 413, and synthesis filter sections 411 and 414. Each of the constituent elements will be described in detail below.

In FIG. 9, parts having the same constitution as in FIG. 6 are assigned the same reference signs, and the description thereof will be omitted.

Error spectral parameter decoding section 801 decodes the quantized L-channel signal error spectral parameter information and outputs the obtained decoded L-channel signal error spectral parameters to spectral parameter generation section 803.

Error spectral parameter decoding section 802 decodes the quantized R-channel signal error spectral parameter information and outputs the obtained decoded R-channel signal error spectral parameters to spectral parameter generation section 804.

Spectral parameter generation section 803 converts the monaural signal spectral parameters to monaural signal LPC coefficients and uses the deformation coefficients for the L channel with respect to the monaural signal LPC coefficients, to determine the deformed L-channel LPC coefficients. Because the method of the deformation has been described in Embodiment 2, the description thereof will be omitted. After conversion of the deformed L-channel LPC coefficients to spectral parameters, the decoded L-channel signal error spectral parameters are added and conversion is done again to LPC coefficients. Spectral parameter generation section 803 outputs the LPC coefficients to synthesis filter section 411 as the decoded L-channel LPC coefficients.

Spectral parameter generation section 804 converts the monaural signal spectral parameters to monaural signal LPC coefficients and uses the deformation coefficients for the R channel with respect to the monaural signal LPC coefficients, to determine the deformed R-channel LPC coefficients. Because the method of deformation has been described in Embodiment 2, the description thereof will be omitted. After conversion of the deformed R-channel LPC coefficients to spectral parameters, the decoded R-channel signal error spectral parameters are added and conversion is done again to LPC coefficients. Spectral parameter generation section 804 outputs the LPC coefficients to synthesis filter section 414 as the decoded R-channel LPC coefficients.

In this manner, in the present embodiment, stereo signal encoding apparatus 100, similar to Embodiment 2, estimates the L-channel signal LPC coefficients and the R-channel signal LPC coefficients from the relationship between the L-channel signal frame energy and the R-channel signal frame energy, and then encodes the error signal between these estimated values and the original signals (in this case, the L-channel signal LPC coefficients and the R-channel signal LPC coefficients). Stereo signal decoding apparatus 200 compares the frame energy of the L-channel signal with the frame energy of the R-channel signal and, using the comparison result, the monaural signal spectral parameters, the decoded L-channel signal error spectral parameters, and the decoded R-channel signal error spectral parameters, calculates the decoded L-channel signal LPC coefficients and the decoded R-channel signal LPC coefficients.

That is, if spectral profile of the background noise signal is represented by LPC coefficients, similar to Embodiment 2, in addition to the encoded data of the LPC coefficients of a monaural signal, stereo signal encoding apparatus 100 adds, as information added to the LPC coefficients of the monaural signal, the frame energies of each of the L-channel signal and the R-channel signal (information regarding the L-channel signal and the R-channel signal). Additionally, in the present embodiment, stereo encoding apparatus 100 adds the difference between the L-channel signal spectral parameters (L-channel signal LPC coefficients) and the estimated L-channel signal spectral parameters (deformed L-channel LPC coefficients) (information regarding the L-channel signal) and the difference between the R-channel signal spectral parameters (R-channel signal LPC coefficients) and the estimated R-channel signal spectral parameters (deformed R-channel LPC coefficients) (information regarding the R-channel signal).

In this manner, by encoding the error components of the LPC coefficients after estimation, stereo signal encoding apparatus 100 encodes efficiently with a small number of bits, and can reduce the bit rate.

Stereo signal encoding apparatus 100 deforms the LPC coefficients of the channel signal having the smaller frame energy between the channel signals constituting the stereo signal, in the direction that increases the degree of making those coefficients white. As a result, even if stereo signal decoding apparatus 200 receives only the LPC coefficients for a monaural signal, high-quality background noise can be generated.

Thus, in the present embodiment, even when only the LPC coefficients of a monaural signal are transmitted, high-quality background noise can be generated, and also the bit rate can be reduced.

The above completes the description of the embodiments of the present invention.

The present invention may be applied regardless of whether a speech signal or an audio signal is used as the input signal.

The above-noted embodiments have been described for the case in which VAD data indicates a background noise part, with the switching section connecting to the stereo DTX encoding section in the stereo signal encoding apparatus and connecting to the stereo DTX decoding section in the stereo signal decoding apparatus. However, even if the VAD data indicates a non-speech part other than a background noise part (for example, an inactive speech part or the like), it is obvious that the same type of operation and effect can be exhibited.

The present invention is not restricted to the above-noted embodiments, and can be subjected to various modifications.

The stereo signal decoding apparatus in the above-noted embodiments performs processing using encoded data transmitted from the stereo signal encoding apparatus in the above-noted embodiments. The present invention is, however, not restricted in this manner, and as long as the encoded data includes the required parameters and data, processing is possible even if the data is not the encoded data from the stereo signal encoding apparatus in the above-noted embodiments.

Also, even for the case in which a signal processing program for operation is recorded by writing it into a machine-readable recording medium such as a memory, a disk, a tape, a CD, a DVD, or the like, the present invention can be applied, and the same operation and effect as the present embodiments can be obtained.

Although in the above-noted embodiments the description has been for the case of constituting the present invention with hardware, the present invention may be implemented by software in concert with hardware.

Each of the functional blocks used in the descriptions of the above-noted embodiments is typically implemented by an LSI device, which is an integrated circuit. These may be made into a single separate chip, and one chip may be made to include a part or all thereof. In this case, although an LSI device is cited, depending upon the level of integration, this may be called an integrated circuit, a system LSI device, a super LSI device, or an ultra LSI device.

The method of integrated circuit implementation is not restricted to large-scale integration, and implementation may be done by dedicated circuitry or a general-purpose processor. A programmable FPGA (field programmable gate array) or a reconfigurable processor, in which circuit cell connections or settings within an LSI device can be reconfigured after manufacture of an LSI device, may be used.

Additionally, in the event of the appearance of integrated circuit technology taking the place of large-scale integration, either by advances in semiconductor technology or other, derivative technology, the functional blocks may be, of course, integrated using that technology. Biotechnology may also be applied.

The disclosure of Japanese Patent Application No. 2010-256915, filed on Nov. 17, 2010, including the specification, drawings and abstract, is incorporated herein by reference in its entirety.

INDUSTRIAL APPLICABILITY

The present invention is particularly suitable for use in an encoding apparatus that encodes a speech signal or an audio signal that is made up of a L-channel signal and a R-channel signal, and in a decoding apparatus that decodes the encoded signal.

REFERENCE SIGNS LIST

100 Stereo signal encoding apparatus
101 VAD section
102, 105, 202, 205 Switching section
103 Stereo encoding section
104 Stereo DTX encoding section
106 Multiplexing section
200 Stereo signal decoding apparatus
201, 401 Demultiplexing section
203 Stereo decoding section
204 Stereo DTX decoding section
301, 302 Frame energy encoding section
303, 304, 502, 701, 702 Spectral parameter analysis section
305 Average spectral parameter calculation section
306 Average spectral parameter quantization section
307 Average spectral parameter decoding section
308, 209, 708, 709 Error spectral parameter calculation section
310, 311, 710, 711 Error spectral parameter quantization section
312 Multiplexing section
402, 403, 704, 705 Frame gain decoding section
404 Average spectral parameter decoding section
405, 406, 801, 802 Error spectral parameter decoding section
407, 408, 603, 604, 803, 804 Spectral parameter generation section
409, 412 Excitation generation section
410, 413 Multiplication section
411, 414 Synthesis filter section
501 Monaural signal generation section
503 Spectral parameter quantization section
601, 703 Spectral parameter decoding section
602, 706 Frame gain comparison section
707 Spectral parameter estimation section

The invention claimed is:

1. A stereo signal encoding apparatus that encodes a stereo signal having a first channel signal and a second channel signal, the stereo signal encoding apparatus comprising:

a first encoder configured to generate first encoded stereo data by encoding the stereo signal when the stereo signal of the current frame is a speech part;

a second encoder configured to encode the stereo signal when the stereo signal of the current frame is a non-speech part and generate second encoded stereo data by encoding each of monaural signal spectral parameters that are spectral parameters of a monaural signal generated using the first channel signal and the second channel signal, first channel signal information regarding the amount of variation between the spectral parameters of the monaural signal and spectral parameters of the first channel signal, and second channel signal information regarding the amount of variation between the spectral parameters of the monaural signal and spectral parameters of the second channel signal; and a transmitter configured to transmit the first encoded stereo data or the second encoded stereo data, wherein the second encoder includes a first analyzer configured to perform LPC (linear prediction coding) analysis of the first channel signal to generate first spectral parameters;

a second analyzer configured to perform LPC analysis of the second channel signal to generate second spectral parameters;

an average spectral parameter calculator configured to calculate the average of the first spectral parameters and the second spectral parameters as the monaural signal spectral parameters;

a monaural signal encoder configured to encode the monaural signal spectral parameters;

a decoder configured to decode the encoded data of the monaural signal spectral parameters to generate decoded spectral parameter;

a first error calculator configured to calculate the difference between the decoded spectral parameters and the first spectral parameters as the first channel signal information;

a second error calculator configured to calculate the difference between the decoded spectral parameters and the second spectral parameters as the second channel signal information;

a first channel signal encoder configured to encode the first channel signal information; and a second channel signal encoder configured to encode the second channel signal information.

2. A stereo signal decoding apparatus, comprising:

a receiver configured to obtain first encoded stereo data to be generated when a stereo signal having a first channel signal and a second channel signal is a speech part in an encoding apparatus or second encoded stereo data to be generated when the stereo signal is a non-speech part in the encoding apparatus;

a first decoder configured to obtain a first decoded stereo signal by decoding the first encoded stereo data; and a second decoder configured to decode the second encoded stereo data, obtaining a second decoded stereo signal having a first decoded channel signal and a second decoded channel signal, using monaural signal spectral parameters that are spectral parameters of a monaural signal generated using the first channel signal and the second channel signal, the first channel signal and the second channel signal being obtained from encoded data included in the second encoded stereo data, first channel signal information regarding the amount of variation between the spectral parameters of the monaural signal and spectral parameters of the first channel signal, and second channel signal information regarding the amount of variation between the spectral parameters of the monaural signal and spectral parameters of the second channel signal, wherein the first channel signal information indicates the difference between the monaural signal spectral parameters and the first channel signal spectral parameters, and a first energy that is an energy of the first channel signal;

the second channel signal information indicates the difference between the monaural signal spectral parameters and the second channel signal spectral parameters, and a second energy that is an energy of the second channel signal; and the second decoder includes a first spectral parameter generator configured to generate first spectral parameters that are the spectral parameters of the first channel signal, using the monaural signal spectral parameters and the first channel signal information;

a second spectral parameter generator configured to generate second spectral parameters that are the spectral parameters of the second channel signal, using the monaural signal spectral parameters and the second channel signal information;

a first synthesis filter configured to pass an excitation signal multiplied by the first energy through a synthesis filter constituted by LPC (linear prediction coding) coefficients obtained from the first spectral parameter to generate the first decoded channel signal; and a second synthesis filter configured to pass an excitation signal multiplied by the second energy through a synthesis filter constituted by LPC coefficients obtained from the second spectral parameter to generate the second decoded channel signal.

3. A stereo signal encoding method that encodes a stereo signal having a first channel signal and a second channel signal, the stereo signal encoding method comprising:

generating first encoded stereo data by first encoding the stereo signal when the stereo signal of the current frame is a speech part;

second encoding the stereo signal when the stereo signal of the current frame is a non-speech part and of generating second encoded stereo data by encoding each of: monaural signal spectral parameters that are spectral parameters of a monaural signal generated using the first channel signal and the second channel signal; first channel signal information regarding the amount of variation between the spectral parameters of the monaural signal and spectral parameters of the first channel signal; and second channel signal information regarding the amount of variation between the spectral parameters of the monaural signal and spectral parameters of the second channel signal; and transmitting the first encoded stereo data or the second encoded stereo data, wherein the second encoding includes performing LPC (linear prediction coding) analysis of the first channel signal to generate first spectral parameters;

performing LPC analysis of the second channel signal to generate second spectral parameters;

calculating an average of the first spectral parameters and the second spectral parameters as the monaural signal spectral parameters;

encoding the monaural signal spectral parameters;

decoding the encoded data of the monaural signal spectral parameters to generate decoded spectral parameter;

calculating the difference between the decoded spectral parameters and the first spectral parameters as the first channel signal information;

calculating the difference between the decoded spectral parameters and the second spectral parameters as the second channel signal information;

encoding the first channel signal information; and encoding the second channel signal information.

4. A stereo signal decoding method comprising:

obtaining first encoded stereo data to be generated when a stereo signal having a first channel signal and a second channel signal is a speech part in an encoding apparatus or second encoded stereo data to be generated when the stereo signal is a non-speech part in the encoding apparatus;

obtaining a first decoded stereo signal by first decoding the first encoded stereo data; and second decoding the second encoded stereo data, obtaining a second decoded stereo signal having a first decoded channel signal and a second decoded channel signal, using monaural signal spectral parameters that are spectral parameters of a monaural signal generated using the first channel signal and the second channel signal, the first channel signal and the second channel signal being obtained from encoded data included in the second encoded stereo data, first channel signal information regarding the amount of variation between the spectral parameters of the monaural signal and spectral parameters of the first channel signal, and second channel signal information regarding the amount of variation between the spectral parameters of the monaural signal and spectral parameters of the second channel signal, wherein the first channel signal information indicates the difference between the monaural signal spectral parameters and the first channel signal spectral parameters, and a first energy that is an energy of the first channel signal;

the second channel signal information indicates the difference between the monaural signal spectral parameters and the second channel signal spectral parameters, and a second energy that is an energy of the second channel signal; and the second decoding including generating first spectral parameters that are the spectral parameters of the first channel signal, using the monaural signal spectral parameters and the first channel signal information;

generating second spectral parameters that are the spectral parameters of the second channel signal, using the monaural signal spectral parameters and the second channel signal information;

passing an excitation signal multiplied by the first energy through a synthesis filter constituted by LPC (linear prediction coding) coefficients obtained from the first spectral parameter to generate the first decoded channel signal; and passing an excitation signal multiplied by the second energy through a synthesis filter constituted by LPC coefficients obtained from the second spectral parameter to generate the second decoded channel signal.

* * * * *